United States Patent [19]

Korenblit

[11] 4,076,303

[45] Feb. 28, 1978

[54] EASY CHAIRS

[76] Inventor: Shalom Korenblit, Shderot Hayeled, Ramat Gan, Israel

[21] Appl. No.: 705,130

[22] Filed: Jul. 14, 1976

[30] Foreign Application Priority Data

Jul. 30, 1975 Israel ..... 47839

[51] Int. Cl.[2] ..... A47C 1/034

[52] U.S. Cl. ..... 297/30; 297/433

[58] Field of Search ..... 297/27, 28, 30, 433, 297/69

[56] References Cited

U.S. PATENT DOCUMENTS

| | | | |
|---|---|---|---|
| 507,921 | 10/1893 | O'Brien | 297/433 X |
| 508,690 | 11/1893 | Fauber | 297/433 X |
| 2,024,170 | 12/1935 | Kruse | 297/433 X |
| 2,560,985 | 7/1951 | Rideout | 297/27 X |
| 2,571,463 | 10/1951 | Lorenz | 297/30 |
| 2,633,896 | 4/1953 | Thompson | 297/433 X |
| 2,964,099 | 12/1960 | Panicci | 297/28 X |

FOREIGN PATENT DOCUMENTS

| | | | |
|---|---|---|---|
| 1,328,387 | 4/1963 | France | 297/30 |

*Primary Examiner*—Francis K. Zugel

*Attorney, Agent, or Firm*—Browdy and Neimark

[57] ABSTRACT

An easy chair has two pairs of legs, the two legs in a pair being hingedly connected to form an inverted V - like structure, a seat being positioned and being hingedly connected to the legs, a back being hinged to the rear edge of the seat, arm rests being slidable on the upper ends of the legs and being hingedly connected to the back rest. A foot rest is swingably connected to the frame of the seat, means being provided to hold the foot-rest in an angular position relative to the plane of the seat, selected from several such positions.

1 Claim, 3 Drawing Figures

EASY CHAIRS

BACKGROUND OF INVENTION

The present invention relates to adjustable and collapsible easy chairs and more particularly to easy chairs with a leg support.

There are known two kinds of such easy chairs, namely one type in which the leg support is raised automatically in accordance with the movement of the back support, being connected thereto by a linkage i.e. the rearward movement of the back support causing the leg support to rise. Thus, in such a chair — when the occupier of the chair leans back recliningly, the footrest rises and the person in in the chair assumes a practically lying position. It is impossible — in such a chair — to sit upright, but to have the legs, especially the calves, supported on the leg support. The second kind of chair is without the said automatic movement, but it affords the possibility for a person to sit upright with the legs of that person raised. In this position the leg support is at a level with the seat. In that second type of chair the leg support, when not in use is folded under the chair. It can be seen that both arrangements are inconvenient in use and provide only for two positions of use: in one type the leg support depends on the position of the back rest, in the second type the leg support is either folded under the seat and inaccessible or at level with the seat.

OBJECTS OF THE INVENTION

It is an object of the invention to do away with the above disadvantages and more particularly to provide a folding easy chair having a leg support which is easy to handle, simple in construction, which may be given more than two positions of the leg support and which affords a better leg support.

SHORT SUMMARY OF THE INVENTION

According to the invention there is provided a leg support for an easy chair which comprises a main U-shaped frame part which is swingably connected to the seat frame of the chair and is additionally supported by a pair of extensible struts which are hingedly connected to the front legs of the chair and to the said frame part of the leg support.

In an especially advantageous form of the chair, the said extensible struts consist of two telescoping parts, means being provided for immobilising the telescoping parts in relation to one another at different points of penetration.

According to another specially advantageous embodiment of the invention the ends of the leg support frame are bent at the juncture of the frame to the seat, so that in position of use the main level of the leg support is higher than the level of the seat.

SHORT DESCRIPTION OF DRAWINGS

FIG. 1 of the drawings is a side view of the new easy chair when the leg support is not is use.

FIG. 2 is a perspective view of the leg support when in use, while FIG. 3 shows an arrangement for adjusting the position of use of the leg support.

DESCRIPTION OF PREFERRED EMBODIMENT

Figure 1:
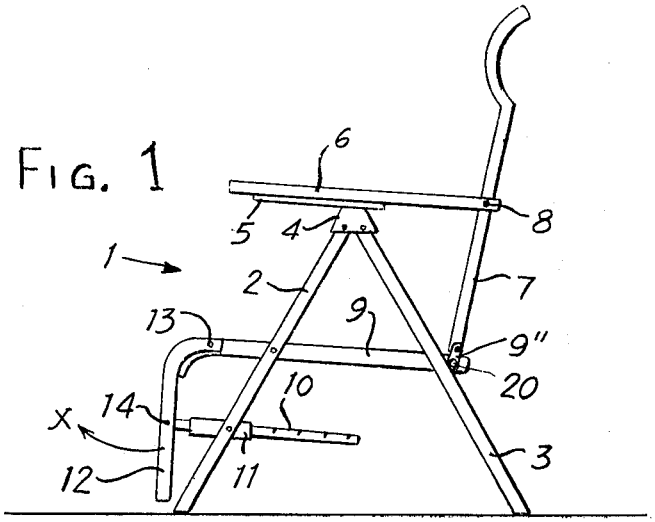
Figure 2:
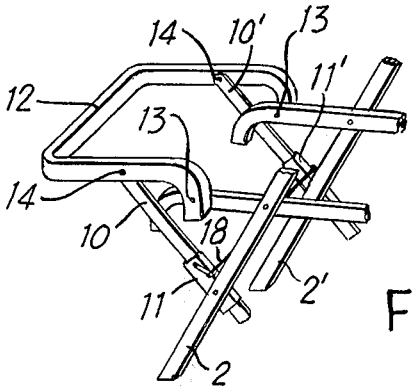
Figure 3:
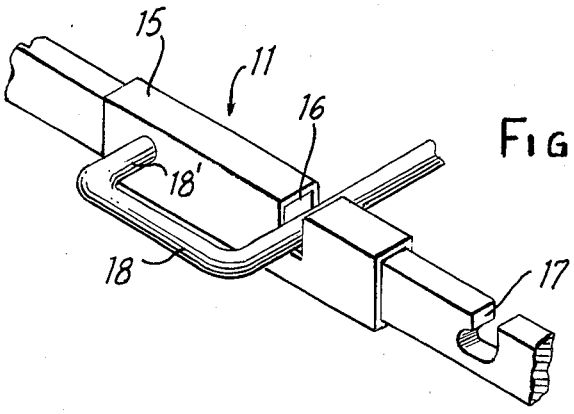

Turning first to FIG. 1 the easy chair is provided with front legs 2 (2'), rear legs 3 (3') which at their upper ends are hingedly connected to a plate member 4 which slides in a rail 5 connected to the underside of arm rest 6 which in turn is hingedly connected to a back rest 7 at 8. Thus the two legs in a pair form an inverted V. Between the legs 2, 3 and 2', 3' (not seen in the drawing) is positioned the seat 9 being journalled to the front legs 2, 2' at 9'. Between the seat frame 9 and the rear leg 3, (3') extends a link 9'' which at both its ends is affixed pivotally both to the seat frame and the leg and which at its end carries an outwardly extending pin lying across the rear leg 3 (3') and thus supports the seat in all positions of the latter. To the seat 9 is hingedly connected the leg support 12. The leg support consists of a bow shaped member 12 which at its ends 13 is pivotally connected to the edges of the seat 9. In order to get a better and more comfortable leg position the ends of the leg support are bent through approximately 90° at its connection to the chair's seat. This causes the leg support to be above the level of the seat 9 so offering a more comfortable sitting position. To the leg support 12 are hingedly connected a pair of struts 10 (10'). The two struts slide telescopingly in tubular adjusting members 11 which are hingedly connected to the front legs 2 and 2'.

The use and function of the easy chair is in the conventional manner. The desired back rest position is gained by lifting slightly arm rest 6 and moving it backwards. So far the operation is known. The new leg support functions as follows:

The leg support 12 is lifted in the direction of arrow x to the desired position, the support swings around pivots 13. At points 14 and 14' forwardly from points 13 are connected the struts 10 and 10' respectively. The movement of the leg support 12 causes the struts to move in the tubular adjusting member 11. Said adjusting member comprises a sleeve 15 in which a strut slides. Said sleeve 15 is provided with a crosswise extending slot 16 which can be brought in register with one of several slots 17 in struts 10, 10'. To the sleeve 15 is connected a bow shaped bar 18 which pivots about an axis 18'. Said bar 18 can be entered into slot 16 and into one of slots 17, thus locking strut 10 and preventing its movement, and so holding the leg support 12 in position. The leg support is released by lifting bar 18' out of slot 16. Instead of using the bar 18 there can be used a wing screw or any other conventional arrangement, immobilizing the struts 10 in the sleeves 15.

What is claimed is:

1. In an easy chair having two pairs of legs, the two legs in a pair being hingedly connected at their upper ends to form an inverted V - like structure, a seat being positioned between the two pairs of legs, a back support being connected to the seat to be angularly adjustable in relation to the seat, a support for the legs of a person occupying the chair being provided, such support being swingable relative to the seat, the improvement wherein said leg support comprises a main U-shaped frame part which is swingably connected to the seat frame of the chair, the ends of said U-shaped frame part being bent through approximately 90° at the connection to the seat frame, and a pair of extensible struts which are hingedly connected to the front legs of the chair and to the said frame part of the leg support, each of said extensible struts comprising a sleeve pivotally connected to the front leg of the chair, a strut telescopically slidable within said sleeve, said strut being pivotably connected to said U-shaped frame part, a series of spaced locking slots formed in said strut, a crosswise extending slot in said sleeve, and a locking bar pivotally connected to said sleeve, said locking bar entering said crosswise extending slot in said sleeve and engaging one of said locking slots in said strut, whereby said strut is locked relative to said sleeve, whereby in position of use of the leg support, the main-horizontal-portion of said frame part is locked in position at a higher level than the seat.

* * * * *